United States Patent [19]

Copas et al.

[11] Patent Number: 5,061,522

[45] Date of Patent: Oct. 29, 1991

[54] JET WIPING APPARATUS AND PROCESS

[75] Inventors: Raymond J. Copas, Williamstown; Colin J. Grace, Mount Hutton; Malcolm A. Robertson, East Maitland, all of Australia

[73] Assignee: Australian Wire Industries Pty. Limited, Sydney, Australia

[21] Appl. No.: 399,898

[22] Filed: Aug. 29, 1989

[30] Foreign Application Priority Data

Sep. 13, 1988 [AU] Australia ..... PJ0403

[51] Int. Cl.[5] ..... B05D 3/04

[52] U.S. Cl. ..... 427/349; 118/63; 118/68; 118/69; 118/405; 118/420; 427/398.1; 427/431; 427/434.2; 427/436

[58] Field of Search ..... 427/348, 349, 398.1, 427/431, 434.2, 436; 118/63, 65, 68, 69, 405, 419, 420, DIG. 18; 15/306.1; 34/155, 160; 134/199; 68/5 D, 5 E, 6

[56] References Cited

U.S. PATENT DOCUMENTS

| | | | |
|---|---|---|---|
| 2,194,565 | 3/1940 | Moss | 134/15 |
| 2,536,186 | 1/1951 | Keller | 427/334 |
| 2,835,121 | 5/1958 | Diss | 68/6 |
| 3,060,889 | 10/1962 | Knapp | 118/63 |
| 3,270,364 | 9/1966 | Steele | 15/306 A |
| 3,611,986 | 10/1971 | Piersee | 118/63 |
| 3,707,400 | 12/1972 | Harvey et al. | 427/349 |
| 3,736,174 | 5/1973 | Moyer | 427/349 |
| 3,917,888 | 11/1975 | Beam et al. | 118/63 |
| 4,198,922 | 4/1980 | Gwilt | 118/63 |
| 4,287,238 | 9/1981 | Stavros | 427/349 |

FOREIGN PATENT DOCUMENTS

| | | | |
|---|---|---|---|
| 458892 | 2/1975 | Australia . | |
| 462301 | 6/1975 | Australia . | |
| 537944 | 7/1984 | Australia . | |
| 539396 | 9/1984 | Australia . | |
| 544277 | 5/1985 | Australia . | |
| 54-24969 | 8/1979 | Japan | 118/63 |

*Primary Examiner*—Shrive Beck
*Assistant Examiner*—Terry J. Owens
*Attorney, Agent, or Firm*—Poms, Smith, Lande & Rose

[57] ABSTRACT

In the gas jet wiping of galvanized wire strip or tube the gas jet wiping nozzle and, preferably a reactive gas containment vessel used for modifying the surface coating on the wire, are made in two or more non-annular parts which when abutted together form an annulus. The parts may be releasably held together in their abutted annular form until the wire, strip or tube requires to be rethreaded, then the parts can be separated from one another transversely of the direction of travel of the wire, strip or tube through the nozzle or containment vessel. The threading of the wire, strip or tube through an annular nozzle or containment vessel is thereby avoided.

9 Claims, 4 Drawing Sheets

JET WIPING APPARATUS AND PROCESS

Figure 1:
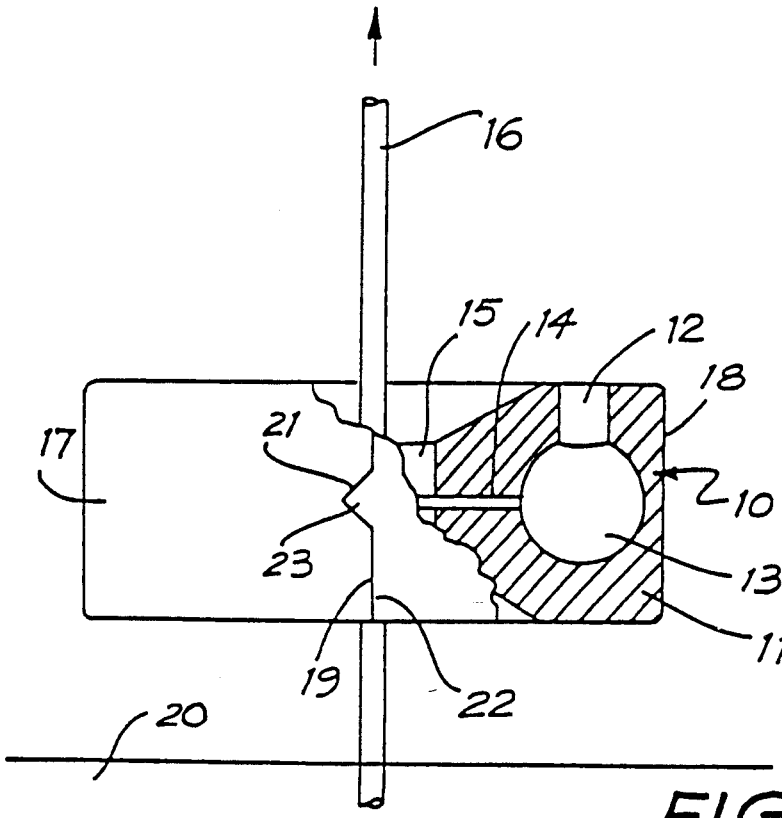

The present invention relates to an improved process for the gas jet wiping of metallic filaments which have been dip coated in a molten metal bath, to apparatus for carrying out such a process and to an improved method for threading a filament through such an apparatus.

When metal filaments, such as metal wire, strip or tube, are dip coated in a molten metal, for instance in molten zinc, aluminium or their alloys, it is normally necessary to strip excess molten metal from the surface of the filament. There are a number of known ways of achieving this, one of which is generally called gas jet wiping. In gas jet wiping processes a stream of a gas is caused to impinge upon the filament to strip the excess coating material therefrom. Typical gas jet wiping apparatus and nozzles therefore are described in the following patent specifications:

| | |
|---|---|
| U.S. Pat. No. | 2,194,565 |
| | 3,060,889 |
| | 3,270,364 |
| | 3,611,986 |
| | 3,707,400 |
| | 3,736,174 |
| | 4,287,238 |
| Australian | 458,892 |
| | 537,944 |
| | 539,396 |
| | 544,277 |

The present applicants have recently discovered that the quality of the surface of metallic filaments which have been coated with a molten metal and wiped, by jet wiping or another wiping method, may be improved by passing the filament through a vessel containing a reactive gas such as hydrogen sulphide prior to being cooled. This discovery is the subject of the present applicants copending Australian patent application No. PJ 0030 entitled "Further Improved Product and Process" the contents of whereof are incorporated herein by reference.

One difficulty associated with all conventional gas jet wiping nozzles and with the applicants newly discovered reactive gas containment vessel is that when a new filament is to be threaded through the gas jet wiping apparatus or if the filament breaks and has to be rethreaded it is difficult and sometimes time consuming to thread the filament upwardly through the relatively small throat of the gas jet wiping nozzle and upwardly through the reactive gas containment vessel given that these pieces of apparatus are often positioned closely adjacent the surface of a very hot bath of molten metal.

In a first aspect the present invention comprises a gas jet wiping nozzle or a reactive gas containment vessel for use in the gas jet wiping of a filament, in which the nozzle or the containment vessel is formed of at least two non-annular parts which when abutted together form an annulus, the at least two parts being separable from one another in a direction transverse to the direction in which, in use, a filament would pass through the nozzle and/or the containment vessel, means being provided to releasably retain the at least two parts in operational abutment.

In a still further aspect the present invention comprises apparatus for the coating of a metallic filament with a molten metal, comprising a molten metal bath, means to draw a filament from the molten metal bath and through the apparatus, a gas jet wiping nozzle through which the filament passes and cooling means adapted to cool the filament by contacting it with a cooling fluid, characterized in that the gas jet wiping nozzle is a nozzle according to the present invention and/or in that a reactive gas containment vessel according to this invention is positioned between the gas jet wiping nozzle and the cooling means.

In a further aspect the present invention comprises a process for the gas jet wiping of a metallic filament passing upwardly from a molten metal bath, wherein the filament passes through a gas jet wiping nozzle and/or a reactive gas containment vessel according to this invention.

In a still further aspect the present invention comprises a method of threading a filament in an apparatus for coating the filament with a molten metal. The method comprises the steps of:

(i) separating at least one part of the gas jet wiping nozzle from the other part or parts to which it is releasably connected, (ii) passing the filament through the bath, upwardly between the separated nozzle parts and through the cooling means, and (iii) bringing the nozzle parts together into operational abutment about the filament.

The gas jet wiping nozzle of the present invention may be of any conventional construction but, it is preferably constructed according to Applicant's copending Australian patent application No. PJ 0032 entitled "Improved Product and Process". The contents thereof are incorporated herein by reference.

The essential feature of the present invention is that the nozzle and/or the reactive gas containment vessel be separable into parts such that the filament does not have to be threaded through the throat of the nozzle or the vessel but rather the nozzle or vessel parts are separated laterally while the filament is positioned in the apparatus and then brought together in operational abutment about the threaded filament.

The nozzle may be cut diametrically into two equal parts with plane abutting faces. It is preferred, however, that means be provided on the parts to ensure that when abutting the gas passages, the respective parts of the nozzle are in alignment. In one embodiment of the invention this is done by forming a ridge on an abutting face of one part of the nozzle and a corresponding groove on the abutting face of the other part. While it is preferred that the nozzle is cut into only two parts it is recognised that the advantages of the present invention could be obtained with a nozzle cut into three or more parts.

The faces of the parts must be capable of being brought into operational abutment. In respect of the nozzle the term "operational abutment" is used in this specification to indicate that there is a sufficient contact between the faces that there is only a limited possibility for wiping gas to flow out of the nozzle between the abutting faces of the nozzle parts rather than through the gas passage. In respect of the gas containment vessel the term "operational abutment" is used in this specification to indicate that there is sufficient contact between the faces that there is only a limited possibility for reactive gas to leak from the containment vessel other than through the filament inlet and outlet apertures. It has been surprisingly found that this is quite easy to achieve by simple machining of the abutting faces and that, contrary to expectation, there is no significant gas loss in either case.

The nozzle or containment vessel parts may be held in abutment by any suitable means. These means may comprise a simple clamp which fits about the nozzle or vessel. In an alternative embodiment spring pins are used to both align the parts and to releasably hold them together. Alternatively the parts, or at least one of them, may be mounted on a double acting hydraulic or pneumatic ram which can be actuated to move the parts, or at least one of them, relatively into or out of operational abutment. If desired one part may be fixed and the other moveable or they may both be moveable. If desired the parts may be hingedly or slidably connected together. In one particular embodiment the nozzle parts are provided with corresponding dovetailed grooves and ribs. The nozzle parts in this embodiment of the invention are initially moved apart axially of the nozzle to separate the corresponding dovetail ribs from the dovetail grooves and are then moved apart radially to allow replacement of the filament.

As used in this specification the term "filament" is taken to mean wire, both circular and non-circular in cross-section, narrow strip material having a width no more than 10 times its thickness and tubular material. The non-circular wire may be angled in cross-section. The invention is most particularly applicable to the coating of wires having a diameter or maximum cross-sectional dimension of from 1 to 20 mm. The wire, strip or tube is preferably made of a ferrous metal such as steel. The present invention is particularly suitable for use in the coating of metal filaments with molten metals such as zinc, aluminium and alloys thereof.

If the apparatus is to include a reactive gas containment vessel this is preferably as described in Applicants copending Australian patent application No. PJ 0030 entitled "Further Improved Product and Process". The above comments in connection with the retaining means for the nozzle parts are applicable equally to the reactive gas containment vessel.

Figure 2:
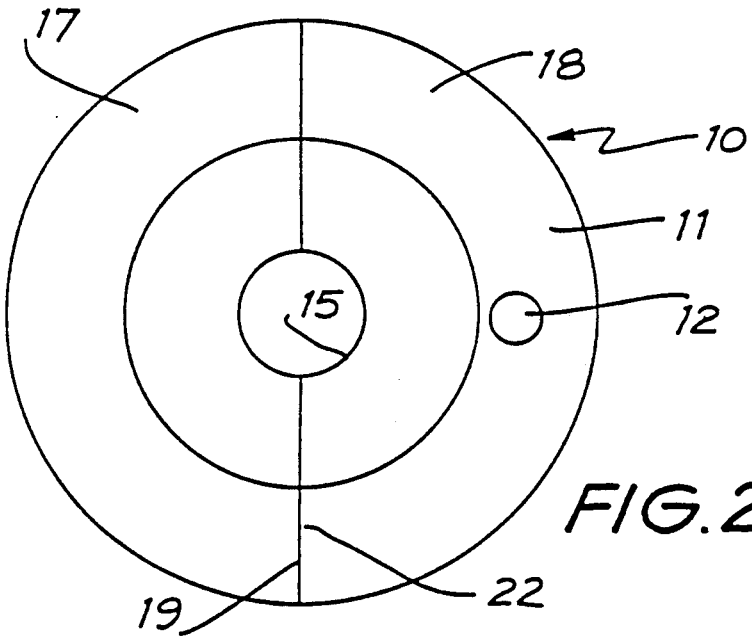
Figure 3:
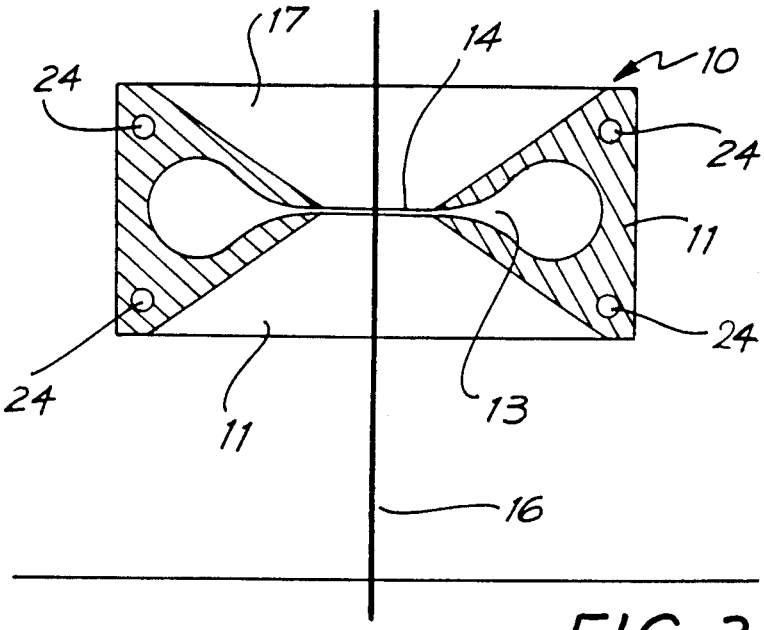
Figure 4:
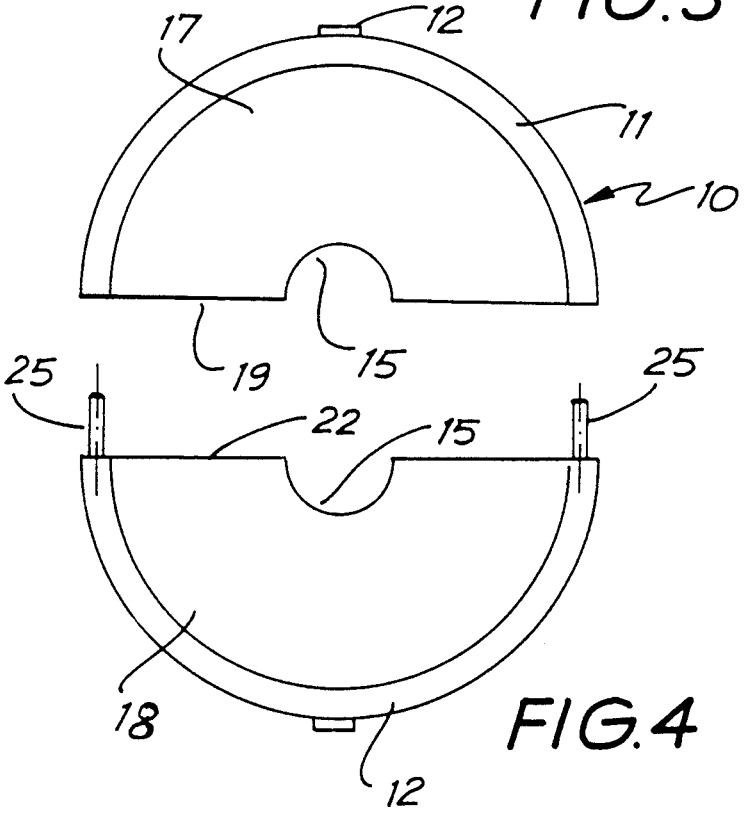
Figure 5:
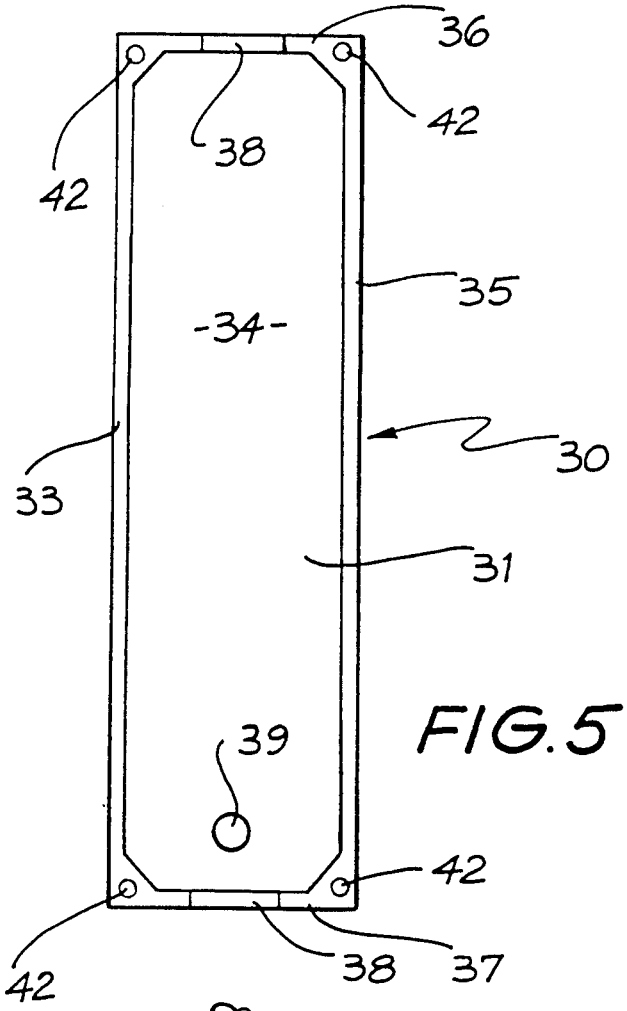
Figure 6:
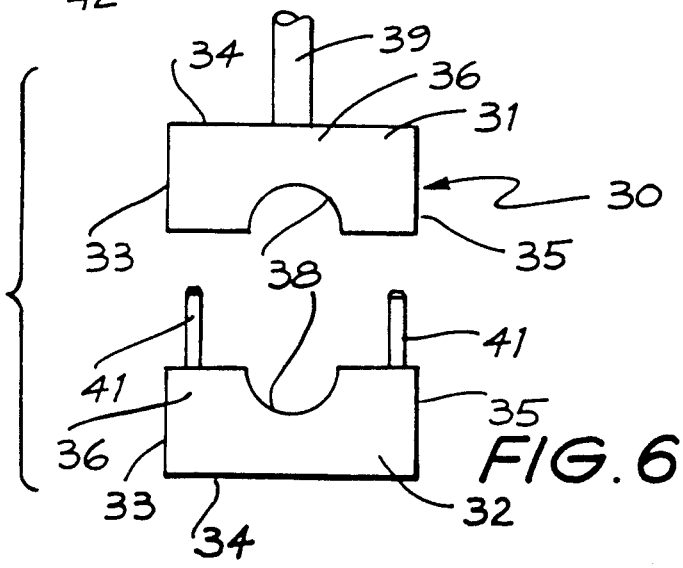
Figure 7:
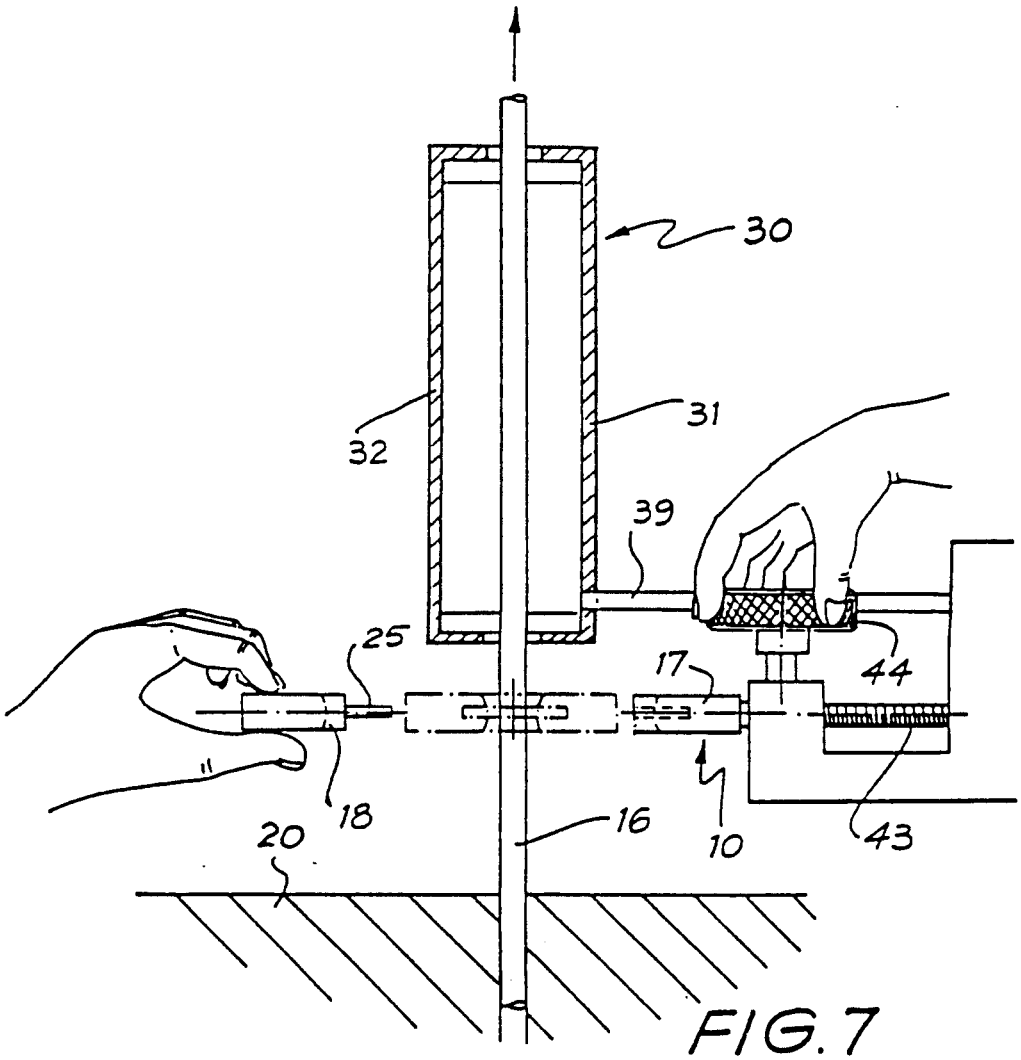

Hereinafter given by way of example only is a preferred embodiment of the present invention described with reference to the accompanying drawings in which:

FIG. 1 is a partly cut away side elevational view of a gas jet wiping nozzle according to a first embodiment of the present invention, FIG. 2 is a plan view of the gas jet wiping nozzle of FIG. 1, FIG. 3 is a diametric sectional view through a gas jet wiping nozzle according to a second embodiment of the present invention, FIG. 4 is a plan view of the gas jet wiping nozzle of FIG. 1 showing the parts separated from one another, FIG. 5 is a side elevational view of one half of a reactive gas containment vessel according to this invention showing the face thereof adapted to abut against another corresponding half, FIG. 6 is a plan view of the reactive gas containment vessel of which the half shown in FIG. 5 forms part, and FIG. 7 is a side elevational view, partly cut away, of gas jet wiping apparatus including a gas jet wiping nozzle and a reactive gas containment vessel according to the present invention.

The jet wiping nozzle 10 of FIGS. 1 and 2 has an annular body 11 defining a gas inlet 12, a circular gas chamber 13 and a gas passage 14. The gas passage 14 opens into a circular throat 15 through which a wire 16 passes.

The nozzle 10 is split diametrically into two body parts 17 and 18. The body part 17 has on its abutting face 19 a V-shaped groove 21 while the part 18 has on its abutting face 22 a corresponding V-shaped rib 23. Magnets (not shown) are provided in the body part 17 to hold the body parts 17 and 18 in abutment with the rib 23 rested in the groove 21 to align the gas passage 14 in the two body parts 17 and 18.

In use the wire 16 is passed through a zinc coating bath 20, from which it emerges substantially vertically, through the jet wiping nozzle 10 and through cooling means (not shown) of the type shown in Australian patent specification 462,301. If the wire 16 breaks or has for some other reason to be replaced the gas flow through the nozzle 10 will be stopped, the nozzle body parts 17 and 18 manually separated, the new wire passed through the bath 20 in the conventional manner and upwardly to pass between the separated nozzle body parts 17 and 18 through the cooling means in the conventional manner. The nozzle body parts 17 and 18 may be then repositioned in operational abutment around the wire 16 and jet wiping recommenced by starting gas flow through the nozzle 10. This wire replacement has been achieved without the necessity of threading the wire 16 through the relatively small throat 15 as would normally be required.

The gas jet wiping nozzle of FIGS. 3 and 4 is similar to that of FIGS. 1 and 2 and the same numerals have been made to identify similar parts. The principal differences are that the nozzle part 17 is formed with four elongate bores 24 into which fit the pins 25 on the nozzle part 19. The pins 25 are of a spring type having a longitudinally extending diametric slit forming a pair of parallel spring arms. The diameter of the pins 25, in their spring apart condition, is slightly larger than the diameter of the bores 24 such that the pins 25 serve to both align the two parts of the nozzle and to hold them firmly together.

FIGS. 5 and 6 show a reactive gas containment vessel 30 comprising a pair of box-like halves 31 and 32. Each of the halves 31 and 32 comprises three adjacent side walls 33, 34 and 35 and end walls 36 and 37. Each of the end walls 36 and 37 has mid-way along its free edge a scalloped recess 38 to allow the passage of a wire to run between the two halves 31 and 32 when they are abutted. A reactive gas inlet pipe 39 enters the box-like half 31 through the side wall 34. The two halves 31 and 32 may be releasably held with the free edges of side walls 33 and 35 and end walls 36 and 37 abutting by four spring-type pins 41 which extend from half 32 into bores 42 in the half 31.

The use of a gas jet wiping nozzle 10 as shown in FIGS. 3 and 4 and a reactive gas containment vessel 30 is shown in FIG. 7. The nozzle part 17 is mounted on one end of a toothed rack 43 which may be moved radially towards and away from the wire 16 by a pinion (not shown) rotated by a knob 44. In the event that the wire 16 is to be rethreaded the nozzle part 18 can be removed from nozzle part 17 manually. The nozzle part 17 may be then withdrawn radially away from the wire 16 by the manual operation of the knob 44. The reactive gas containment vessel may be similarly opened by manually drawing the half 32 away from half 31. The wire 16 may then be rethreaded through the apparatus and the nozzle 10 and reactive gas containment vessel 30 repositioned about the wire 16.

What is claimed is:

1. A gas jet wiping nozzle for use in gas jet wiping a filament, said gas jet wiping nozzle comprising at least two non-annular parts abutted together to form a hollow annulus, the at least two non-annular parts being separable from one another in a direction transverse to the direction in which, in use, a filament would pass through the gas jet wiping nozzle, means being provided to releasably retain the at least two non-annular parts in operational abutment.

2. The gas jet wiping nozzle as claimed in claim 1, wherein the means provided to releasably retain the at least two non-annular parts in operational abutment comprises a plurality of spring pins on one of the parts and engageable in corresponding bores on another of those parts.

3. The gas jet wiping nozzle as claimed in claim 1, wherein the means provided to releasably retain the at least two parts in operational abutment comprises a magnet or magnets in one or each of the non-annular parts.

4. The gas jet wiping nozzle as claimed in claim 1, wherein the nozzle includes means to ensure that the parts are aligned with one another when abutted together.

5. The gas jet wiping nozzle as claimed in claim 1, wherein the non-annular parts of the gas jet wiping nozzle are hingedly connected together.

6. An improved apparatus for the coating of a metallic filament with a molten metal, wherein the apparatus includes a molten metal bath, a gas jet wiping nozzle, cooling means adapted to cool the filament by contacting it with a cooling fluid and means to draw a filament from the molten metal bath through the gas jet wiping nozzle and through the cooling means, wherein the improvement comprises a gas jet wiping nozzle having at least two non-annular parts abutted together to form a hollow annulus, the at least two non-annular parts being separable from one another in a direction transverse to the direction in which, in use, a filament would pass through the gas jet wiping nozzle, means being provided to releasably retain the at least two non-annular parts in operational abutment.

7. The improved apparatus as claimed in claim 6, in which at least one of the non-annular parts is positioned for sliding movement towards and away from the filament.

8. The improved apparatus as claimed in claim 7, wherein one non-annular part is positioned for sliding movement towards and away from the filament and another non-annular part is manually detachable from the one non-annular part.

9. An improved process for the gas jet wiping of a metallic filament passing upwardly from a liquid metal bath, wherein the filament passes through a gas jet wiping nozzle, wherein the improvement comprises passing said filament through a gas jet wiping nozzle having at least two non-annular parts abutted together to form a hollow annulus, the at least two non-annular parts being separable from one another in a direction transverse to the direction in which said filament passes through the gas jet wiping nozzle, means being provided to releasably retain the at least two non-annular parts in operational abutment.

* * * * *